United States Patent [19]

Helman et al.

[11] 3,948,581

[45] Apr. 6, 1976

[54] KNOCKDOWN FURNITURE ASSEMBLIES

[76] Inventors: Philip L. Helman, 12407 Braxfield Court No. 6, Rockville, Md. 20852; Gary W. Kanegis; Meryl E. Kanegis, both of 13587 N. Vega Drive, N.W.D.C., Littleton, Colo. 80120

[22] Filed: July 2, 1974

[21] Appl. No.: 485,286

[52] U.S. Cl. ..... 312/198; 108/111; 211/86; 312/107; 312/238; 312/245; 312/257 R

[51] Int. Cl.[2] A47B 53/00; A47B 57/12; A47B 57/24; A47F 5/08

[58] Field of Search ..... 108/106, 107, 109, 111, 108/101; 312/198, 257 R, 238, 245, 111; 5/355; 211/86

[56] References Cited

UNITED STATES PATENTS

| | | | |
|---|---|---|---|
| 983,075 | 1/1911 | Masters | 108/107 |
| 1,411,260 | 4/1922 | Baker et al. | 108/107 |
| 1,455,569 | 5/1923 | Caminoni | 312/238 X |
| 1,876,172 | 9/1932 | Ruddy | 108/107 X |
| 2,249,142 | 7/1941 | Kagel | 108/111 |
| 2,658,810 | 11/1953 | Ellis et al. | 312/198 X |
| 2,744,795 | 5/1956 | McDonough | 108/111 X |
| 3,050,194 | 8/1962 | Sinninger | 108/106 |
| 3,200,962 | 8/1965 | Davelaar | 312/111 X |
| 3,234,896 | 2/1966 | Bonsall | 108/111 |
| 3,347,187 | 10/1967 | Khoury | 312/198 X |
| 3,735,979 | 5/1973 | Levenberg | 5/355 |
| 3,828,937 | 8/1974 | Nash | 211/86 |
| 3,830,170 | 8/1974 | Faulstich | 108/111 |
| 3,834,549 | 9/1974 | Burg et al. | 108/111 X |

*Primary Examiner*—Paul R. Gilliam
*Assistant Examiner*—Carl F. Pietruszka
*Attorney, Agent, or Firm*—Samuel Lebowitz

[57] ABSTRACT

A knockdown furniture assembly comprised of a plurality of vertical skeletal supports or standards which may be spaced variably within a room and clamped in position between the floor and ceiling thereof. The skeletal supports are provided with vertically arranged series of cylindrical openings for receiving dowels, pins and/or bolts which engage shelf supports for shelving, or which fasten different furniture units directly to the skeletal supports. The shelves and furniture units may be mounted at any desired levels and in any desired arrangements, including corner shelves in a corner of a room. The units may be installed without need of any special tools or experience.

5 Claims, 19 Drawing Figures

KNOCKDOWN FURNITURE ASSEMBLIES

This invention relates to knockdown furniture assemblies capable of ready installation and disassembly, and capable of supporting all types of furniture units such as shelving, cabinets of all types, magazine racks, headboards, etc.

It is the object of the present invention to provide a rugged and reliable assembly of skeletal supports which may be set up between the floor and ceiling of rooms of many different designs and dimensions, and to adapt the skeletal supports to a universal application in spaces of variable dimensions between walls, windows and doorways.

It is a further object of the invention to provide a knockdown assembly of supports for furniture units of all types and especially shelving, which may be set up between the floor and ceiling of rooms having different heights without need for special tools or skilled labor.

It is another object of the invention to provide knockdown assemblies which may be packaged compactly in the form of kits, and the installations of which may be expanded as the need for additional units arises. The assemblies are also adapted to be knocked down for re-use in other locations in view of the universal adaptability of the components thereof.

The knockdown furniture assembly may be fabricated of wood, plastic, metal or any other materials, and the styling of the assembly may be varied to adapt the same to varying decors by modifying the ornamental appearance of the vertical skeletal supports, especially when these are formed of wood or plastic, which lend themselves to convenient fabricating by woodworking operations or molding.

It is a further object of the invention to provide assemblies which lend themselves to mounting against the walls of a room as well as in inner areas of the room, where they may function as room dividers; the assemblies are also adaptable for mounting at intersecting walls of a room, in the corners thereof.

Other objects and purposes will appear from the detailed description of the invention following hereinafter, taken in conjunction with the accompanying drawings, wherein FIG. 1 is a perspective view of the knockdown furniture assemblies in accordance with the invention, for positioning against two intersecting walls of a room;

Figure 1:
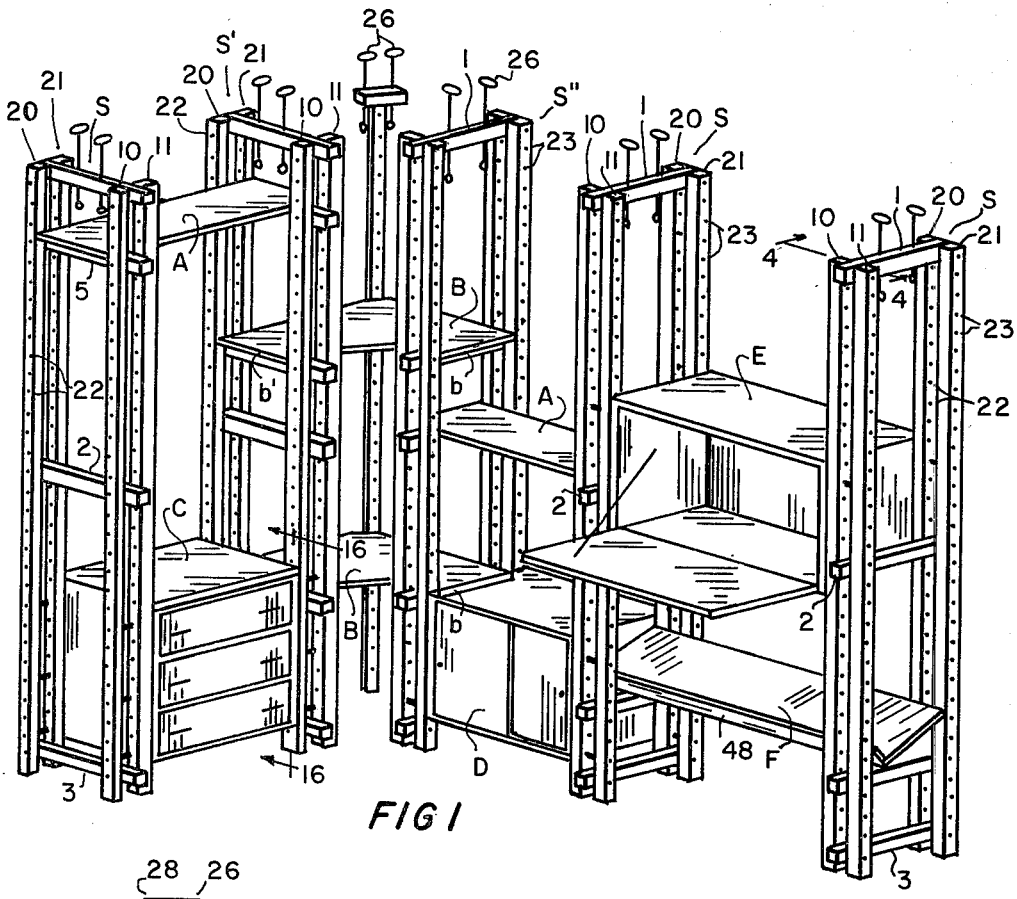

In the drawings, the knockdown assembly in accordance with the invention is shown in FIG. 1 in a set-up state, to illustrate the universal adaptability of relatively few standardized units for the purpose of attaining a wide diversity of mountings for different furniture components.

The principal essential element of the assembly is a vertical skeletal support, five of which are illustrated in FIG. 1, which may be displaced from each other at any desired distances, in parallel to each other along the walls, and in perpendicular planes at the corners, in order to accommodate the assembly to rooms of different wall dimensions and gaps therein occasioned by doors or windows.

The individual skeletal support S is constituted by two pairs of vertical standards, nearly 8 feet in height. In the illustrated embodiment, for the sake of easy illustration, these vertical standards may be lengths of finished wood lumber about 2 inches square in cross-section. Obviously, these lengths may be composed of shorter lengths, which may be interconnected by dowel pins, and these shorter lengths may be turned in different designs to adapt these skeletal supports to varying decors such as Early American, Mediterranean, etc.

The front vertical members or standards 10 and 11 are laterally displaced from each other to form a small gap of about 2½ inches therebetween and the rear pair of members 20, 21 are displaced from each other to a similar extent with the distance between the front pair of members 10, 11 and the rear members 20, 21 being a substantial distance, for example, about 14 inches between longitudinal centers, in order to accommodate the furniture units or shelving within said space. With such dimensions, the shelves may have a width of about 11½ inches.

Figure 3:
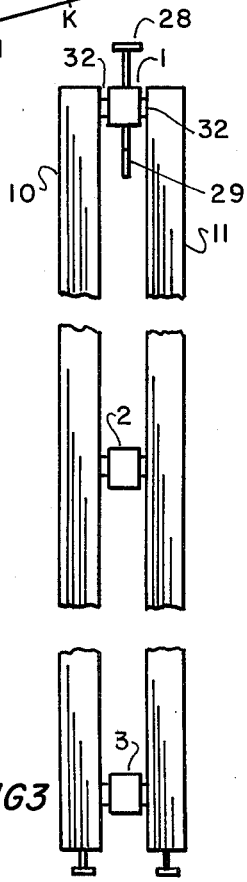
FIG. 3 is a front elevation of FIG. 2.
Figure 2:
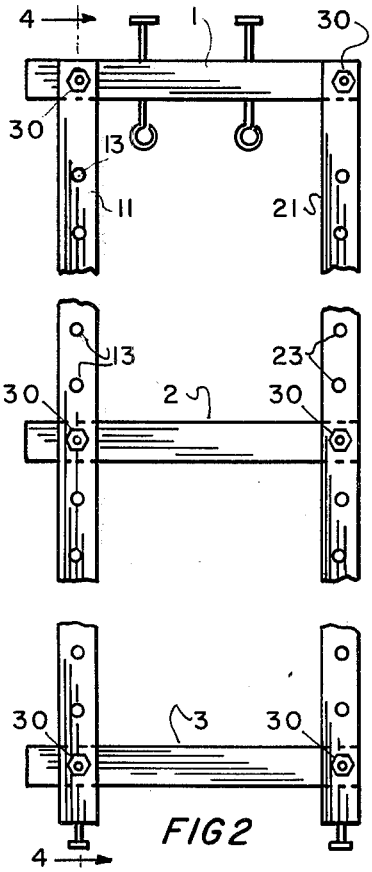
FIG. 2 is an enlarged side view of the skeletal vertical support at the right end of the assembly shown in FIG. 1.

The vertical standards are fixed in place by means of connecting or bracing bars at the top and bottom of the vertical members and preferably at an intermediate point thereof. Thus, as shown in FIGS. 2 and 3, connecting bar 1 is disposed in the small gap between the rear pair of vertical standards 20 and 21 and the front pair of standards 10 and 11, and may protrude a few inches forwardly from the latter. Fastening bolts 30 extend through openings 12 and 13 in standards 10 and 11, respectively, as well as opening 4', (FIG. 6), in connecting bar 1, which, upon tightening of the nut 31 at the end opposite the head of the bolt 30 serves to rigidly interconnect the three members 10, 11 and 1 at the forward end of the top of the skeletal support. Another bolt and nut assembly 30, 31 is passed through opening 4 at the rear end of bracing bar 1 to rigidify the top of the vertical standards with the horizontal connecting bar 1.

Figure 4:
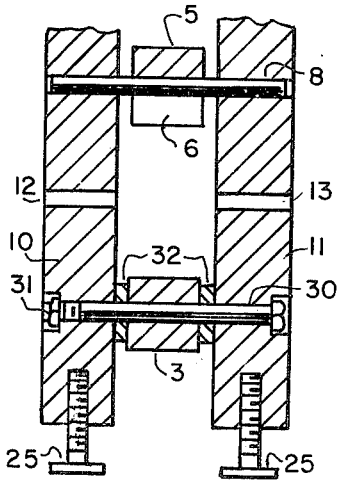
FIG. 4 is a vertical sectional view along lines 4—4 of FIG. 2 with a modification of the elements therein.

As shown in FIG. 4, recessed seats for the head of bolt 30 and nut 31 are drilled on the outer faces of the vertical standards 10, 11, 20 and 21. These recessed seats, of about ⅜ inches in depth and ¾ inches in diameter, house the ends of the ¼ inch × 5 inch carriage bolts, or the like, which traverse the cylindrical passages 12, 13 and 22, 23 in the pairs of vertical standards. Preferably, washers 32 of fiber, plastic, or metal, of about 1/16 inch in thickness, are interposed between the sides of the connecting bar 1 at each end thereof and the vertical standards, as shown at the top of FIG. 4.

Figure 7:
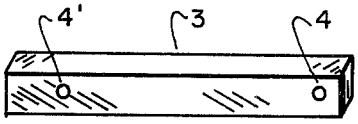
FIG. 7 is a perspective view of the bottom bracing bar of the vertical skeletal support.

The lower ends of the skeletal support are similarly interconnected by means of bottom connecting bar 3, (FIGS. 4 and 7), and fastening bolts and nuts 30, 31. As shown in FIGS. 2 and 3, an intermediate bracing, locking or connecting bar 2 serves to interconnect and rigidify the relative locations of the front and rear pairs of vertical members at an intermediate portion of their length, for example, at about four feet from their lower ends.

In order to accommodate the skeletal supports to rooms having different distances between the floor and ceilings of the rooms, as well as to accommodate the skeletal supports to variations in such distances in the same room, levelling means 25 may be threaded into the lower ends of the vertical members (FIGS. 2 to 4), and rotary clamping means may be fitted in the top locking bar 1. Preferably two of such clamping means are disposed between the front and rear pairs of vertical members at a displacement of about 5½ to 6 inches, in order to secure a reliable clamping of the vertical skeletal support between the floor and ceiling.

Figure 6:
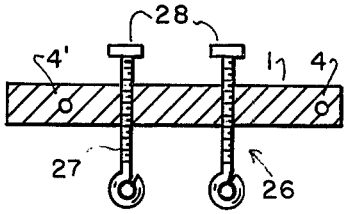
FIG. 6 is a vertical sectional view of the top connecting or bracing bar of the vertical skeletal support.
Figure 9:
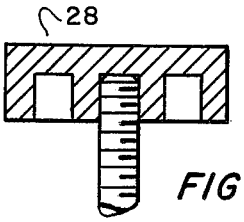
FIG. 9 is an enlarged sectional view of a detail shown in FIG. 6 for clamping the vertical skeletal supports rigidly between the floor and ceiling of a room.

As indicated in FIGS. 6 and 9, the clamping assembly 26 is constituted by an eye bolt 27 having a Nylon or other plastic disc 28 mounted at its upper end and a circular eye opening 29 at its lower end. Rotation of the bolt by the manipulation of the end 29 within a threaded bore in the connecting bar 1, effects movement of the gripping disc 28 relative to the latter. The bolts 27 of ¼ inch × 20 size may cooperate with T-nuts of the same size seated within openings in the top bracing bar 1.

The furniture levellers are disposed in each vertical standard of each pair at the front and rear of the skeletal support, as shown in FIGS. 2 to 4. In some instances the skeletal supports may be clamped in place without benefit of such levellers.

Figure 8:
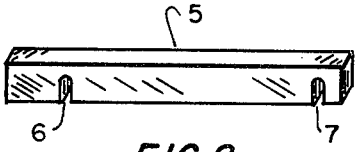
FIG. 8 is a perspective view of one of the supporting bars adapted to be detachably fitted within the vertical skeletal supports for supporting shelves or other units at different levels.

The skeletal vertical supports are so designed that shelving and other furniture units may be mounted thereon after they are fixed in place at desired displacements between the floor and ceiling of a room. To that end, a plurality of aligned cylindrical passages 12, 13, in standards 10 and 11, and 22, 23, in standards 20 and 21, of five-sixteenth inches in diameter, are provided along the lengths of the vertical members at uniform displacements from each other, for example, 3 inches apart, and these openings are at common levels in both the front and rear vertical pairs of members. Cylindrical dowels 8, of ¼ inch in diameter, are adapted to be inserted into such openings (FIG. 4), and supporting elements 5, of a width less than the gap between the respective pairs of front and rear vertical members, are designed to be seated on these dowels. Thus, as shown in FIG. 8, notches 6 and 7 are provided in the lower edge of the supporting elements 5 which are at the same displacement from each other as are the openings 4 and 4' in the top, bottom and intermediate bracing bars 1, 2 and 3, respectively. The openings 17 for the dowel pins are preferably in the same transverse planes as the openings for the integrating bolts and nuts 30, 31, but this is not essential. The selective disposition of the slotted supports 5 on the dowel pins is independent of the assembly of the skeletal supports. The placement of a pair of supporting elements 5 within the gaps of a pair of laterally displaced vertical skeletal supports S on a common level provides support for a shelf A (FIG. 1). Additional supporting elements 5 may be inserted in the gaps of two adjacent skeletal supports S to provide supports for additional shelves A at any desired displacement in elevation from each other.

A basic shelving kit may be provided by a package containing two skeletal supports S, three shelves, six supporting elements 5, and twelve dowels 8. As is evident from FIG. 1, as well as FIGS. 6, 7 and 8, the support elements 5 project beyond the front of the supporting assembly to the same extent as do the bracing bars 1, 2 and 3. The skeletal supports may be shipped in compact assembled form or in kits containing the vertical members, connecting bars 1, 2 and 3, six bolt and nut assemblies, 12 washers, two clamping devices 26 and, if desired, at least four floor levelling devices 25.

Figure 5:
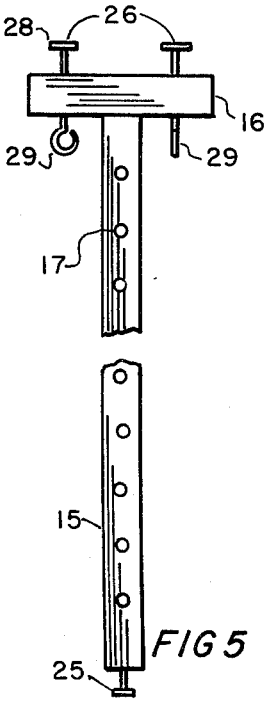
FIG. 5 is a front elevation of a vertical post for mounting at the corner of a room.

The knockdown furniture assembly lends itself to the mounting of corner shelves B by the provision of a vertical post 15, as shown in FIG. 5, which is capped by a horizontal member 16 fitted with a pair of clamping bolt assemblies 26 similar to the elements shown on an enlarged scale in FIGS. 2 to 4, 6 and 9. A floor levelling means 25 may be provided at the lower end of the post 15. The vertical post is provided with cylindrical openings 17 at displacements corresponding to the openings 12, 13 and 22, 23 in the vertical standards of the skeletal supports S, so that when dowel pins 8 are inserted in such openings 17 they provide support for corner shelves B at a point intermediate the free edges *b* and *b'* of the corner shelves, which are adapted to bear on the supporting elements 5 mounted on a common level in skeletal supports S' and S'' disposed in planes perpendicular to each other as shown in FIG. 10, and equidistantly spaced from the corner of the room and extending normally from the walls of the room.

The top bar 16 may be affixed to the vertical post 15 by means of cylindrical dowel members, for example, ¼ inch × 1 inch in size, by flatheaded screws, such as No. 10 × 2½ inches in size, or in any other suitable way.

Figure 11:
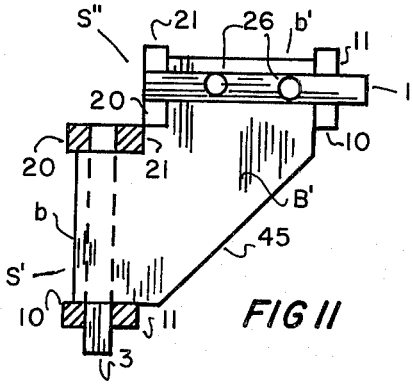
FIG. 11 is a plan view of a modified mounting for the vertical skeletal supports adjacent to perpendicularly arranged walls of a room for supporting corner shelves thereat.
Figure 10:
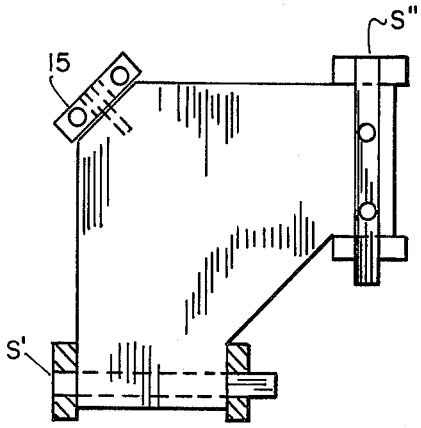
FIG. 10 is an enlarged plan view of the corner of the assembly shown in FIG. 1, illustrating the disposition of the vertical skeletal supports disposed in planes perpendicular to each other in conjunction with the vertical post shown in FIG. 5 for providing supports for corner shelves.

In FIG. 11 is shown an alternative mode of supporting corner shelves from that shown in FIGS. 1 and 10. In the arrangement shown in this figure, the corner post 15 is eliminated and the two skeletal supports S′ and S″ are disposed in planes perpendicular to each other but closely adjacent to the walls of the room. Thus, the shelf supports 5, which are disposed at common levels of the skeletal supports S′ and S″ are adapted to support the edges *b* and *b′* of the corner shelf B′. In this arrangement the edge 45 of the shelf remote from the corner may be contoured either as a straight line or curve, depending upon the decor of the room. The advantageous feature of this arrangement is that easier access is had to the main part of the shelf. Of course, the skeletal supports S extending beyond the free ends of the skeletal supports S′ and S″ must be positioned close to the terminals of the latter to provide the desired shelving and other furniture unit supports along the walls of the room.

Figure 12:
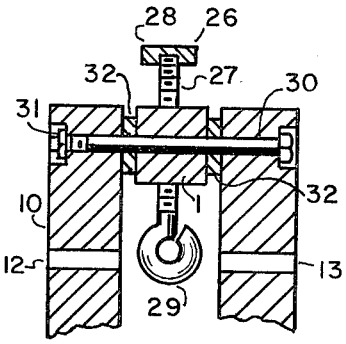
FIG. 12 is a perspective view of adjustable shelving capable of assuming different lengths.
Figure 12:
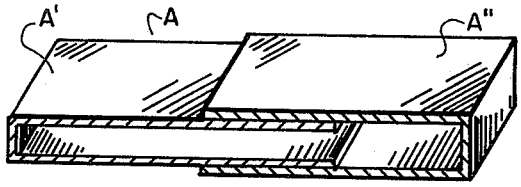

In FIG. 12 is shown an adjustable shelf A which may be formed of metal or plastic, composed of telescopic portions A′ and A″ in order to impart an expansive capability to the shelves in conformity with the variations in lateral displacements of the skeletal uprights S from each other. Such shelving may be marketed in standardized units such as 3 feet, 4 feet, 6 feet, etc., and because of the capability in the adjustment thereof, the separate sizes could be adapted to variable spacings between the skeletal supports S in a manner similar to the marketing of curtain rods and the like.

Figure 13:
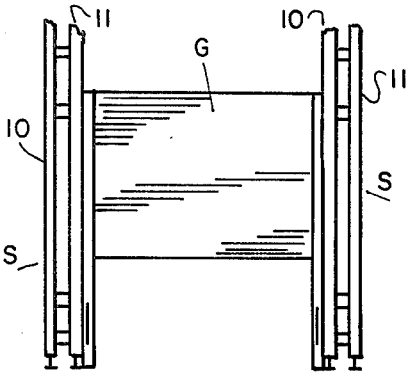
FIG. 13 is a front elevation of a pair of spaced vertical skeletal supports for mounting a headboard therebetween.
Figure 15:
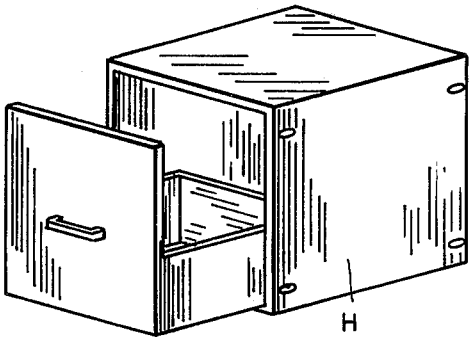
FIG. 15 is a perspective view of a drawer file cabinet for mounting between a pair of vertical skeletal supports as shown in FIG. 1.

In FIG. 13 is shown an arrangement for mounting a detachable headboard G between a front pair of standards 10, 11 if a shelf arrangement is desired at the rear of the headboard. The headboard G is adapted to cooperate with a bed frame mounted in front thereof. This mounting may be executed in the same manner as are the several cabinets shown in FIG. 1, for example, a three-drawer cabinet C, a sliding door cabinet D, and bar-desk cabinet E. The headboard also may be mounted between the rear pairs of standards 20, 21 by means of either threaded bolts or wooden dowels.

Figure 14:
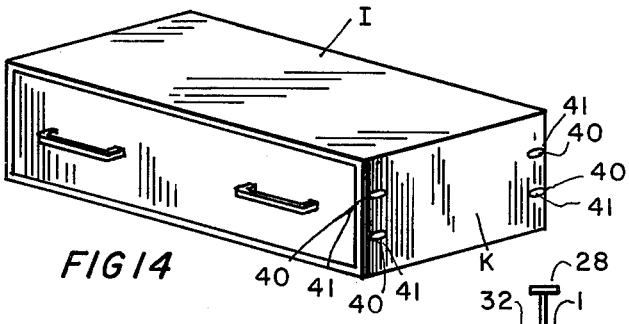
FIG. 14 is a perspective view of a drawer cabinet for mounting between a pair of vertical supports as shown in FIG. 1.
Figure 16:
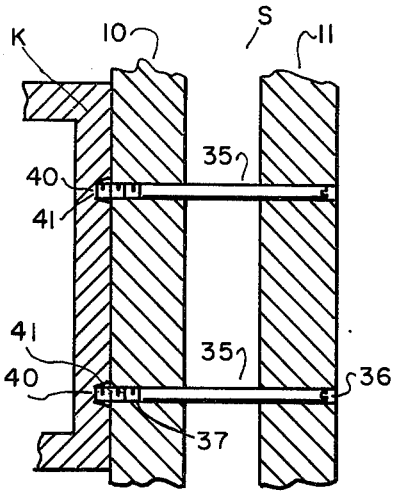
FIG. 16 is a vertical sectional view along lines 16—16 of FIG. 1 to illustrate the mounting of a cabinet on the vertical skeletal support by means of threaded bolts.

In FIGS. 14 and 16 is shown a single drawer cabinet I having lateral walls K which are fitted with cylindrical passages 40 adjacent to the front and rear walls thereof. T-nuts 41 are fitted within these passages adjacent the open ends thereof, for the purpose of accommodating the threaded ends of bolts 35 which are extended through the openings 12, 13 and 22, 23 in a manner similar to simple dowels. The free end of each of the bolts is provided with a kerf 36 to permit the threading of the bolts into the T-nuts 41 in order to support the wall K on the vertical skeletal supports S. If desired, simple wooden dowels 8 may be used in lieu of bolts 35 to support the drawer cabinet. Likewise, bolts 35 may be used interchangeably with wooden dowels 8 as shown in FIG. 4, to support the elements 5 when shelves are supported between the vertical uprights. In such cases, the slots 6 and 7 of members 5 would engage the intermediate parts of the bolts 35 between the vertical standards 10, 11 and 20, 21, as is clearly evident from FIG. 16.

Of course, the mode of supporting the wall K as shown in FIG. 16 may be applied to supporting any of the cabinet units C, D and E shown in FIG. 1.

Figure 17:
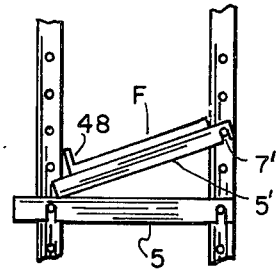
FIG. 17 is a side elevation of the lower portion of the right end of FIG. 1 with the outermost vertical members removed to illustrate the mounting of a magazine rack on the vertical skeletal supports.

A magazine rack F may be supported between the vertical skeletal supports S in a manner more clearly illustrated in FIG. 17. In this case, a pair of supporting members 5′, of shorter length than the main supports 5 and each provided with a single slot 7′, may engage a pair of dowels in adjacent skeletal supports at any desired elevation, as shown in FIG. 17. The shelf F, with a front ledge 48, may rest on the supplemental supports 5′ for the purpose of providing a convenient magazine rack. If desired, each supporting supplemental member 5′ may be of the same length as the members 5, with the rear portion anchored on one of the dowels 8 extending between standards 20, 21 and the front portion resting on a dowel 8 at a lower level in standards 10, 11.

Figure 18:
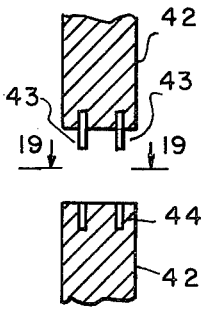
FIG. 18 is an exploded view of another embodiment in which the vertical members of shorter lengths are interconnected to form the vertical skeletal supports.
Figure 19:
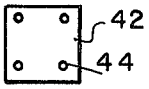
FIG. 19 is a horizontal sectional view along lines 19—19 of FIG. 18, illustrating the location of the connecting dowels between the components of the vertical support.

In order to provide a more compact merchandising package, the vertical standards 10, 11 and 20, 21 may be fabricated in shorter lengths and may be integrated into the full lengths by fastening connections. Thus, FIGS. 18 and 19 show one portion of the vertical standard 42 fitted with dowels 43 extending therefrom which are adapted to interengage with correspondingly positioned openings in the lower member 43. While FIG. 19 shows four dowels at each of the corners of the standard of square cross-section, a lesser number could be used. Of course, other interconnecting means may be used. For example, if cylindrical standards are used, threaded pins and sockets may be employed for integrating the component lengths.

As stated above, the standards 10, 11 and 20, 21 may be formed of materials other than wood, and may be turned and shaped into different surface contours to attain different ornamental effects.

We claim:

1. A knockdown furniture assembly comprising a. a pair of vertical skeletal supports adapted to be laterally spaced a predetermined distance from each other and adapted to be detachably fixed in place between the floor and ceiling of a room, b. each vertical support comprised of a pair of vertical members both at the front and rear thereof with a gap between each pair of members, and provided with a plurality of transverse cylindrical openings along the length thereof, said openings being in alignment in each pair of vertical members, c. substantially horizontal connecting bars adjacent to the top and bottom of each vertical support extending between the front and rear pairs of vertical members within the gap between each pair of members, d. means for rigidly fastening the opposite ends of each connecting bar to the pairs of said vertical members, e. a plurality of cylindrical rods adapted to be inserted into a plurality of aligned pairs of said cylindrical openings in said vertical members, and f. a detachable furniture unit fitting closely within the lateral spacing between said skeletal vertical supports provided with openings on the lateral walls thereof for interengagement with said cylindrical rods.

2. A device as set forth in claim 1, wherein said detachable furniture unit is a headboard adapted to cooperate with a bed.

3. A device as set forth in claim 1, wherein said cylindrical rods are threaded bolts and the openings in the lateral walls of the furniture unit are correspondingly threaded sockets.

4. In a knockdown furniture assembly extending along each of two juxtaposed walls disposed perpendicularly to each other at the corner of a room, comprising a. an independently self-sustaining vertical skeletal support adapted to be fixed detachably between the floor and ceiling of a room, in a plane parallel to each wall and adjacent to said corner, b. said support comprising two pairs of vertical standards displaced a substantial distance from each other, with the standards of each pair spaced from each other by a relatively small gap, and with the respective standard of each pair being in alignment with the respective standard of the widely displaced pair, c. substantially horizontal connecting bars at least at the top and bottom of said skeletal support in the gaps between the vertical standards, and spanning said substantial distance between said pairs of standards, d. elongate fastening means extending through said vertical standards and horizontal connecting bars for integrating said skeletal vertical support, e. each pair of said vertical standards having a plurality of equidistantly displaced coaxial openings at common levels in planes perpendicular to that of said skeletal support, for selectively receiving cylindrical rods adapted to bridge the small gaps therebetween, f. a supporting bar having notches in the bottom edge adjacent to the opposite ends thereof and displaced from each other a distance corresponding to the spacing between said planes, for engaging the cylindrical rods on a common level, passing through each pair of standards, g. floor engaging means at the bottom end of said skeletal support, h. adjustable clamping means at the upper end of said skeletal support for fixing said skeletal support between the floor and ceiling of the room, and i. a polygonal shelf adapted to have adjacent perpeneicular edges resting on the supporting bars on the same level in said skeletal supports adjacent to the corner of the room.

5. A knockdown furniture assembly extending along two juxtaposed walls disposed perpendicularly to each other at the corner of a room, comprising a. a pair of independently self-sustaining vertical skeletal supports adapted to be laterally spaced a predetermined distance from each other and adapted to be detachably fixed in place between the floor and ceiling of a room, b. each vertical support comprised of a pair of vertical members both at the front and rear thereof with a gap between each pair of members, and provided with a plurality of transverse cylindrical openings in planes perpendicular to that of said skeletal support and spaced equidistantly along the length thereof, said openings being in alignment in each pair of vertical members, c. substantially horizontal connecting bars at the top and bottom of each vertical support extending between the front and rear vertical members within the gap of each member, d. means for rigidly fastening the opposite ends of each connecting bar to the pairs of said vertical members, e, a plurality of cylindrical rods adapted to be inserted into a plurality of aligned pairs of said cylindrical openings in said vertical members, f. a supporting element of a width narrower than said gap and provided with notches in the bottom edge thereof at a displacement corresponding to the spacing between the cylindrical rods in the front and rear pairs of vertical members, for detachable seating on said cylindrical rods, g. a detachable shelf adapted to rest upon a pair of said supporting elements, h. a vertical post adapted to be fixed detachably between the floor and ceiling in the corner of said room and provided with openings therein at spaced levels thereof corresponding to the levels of the transverse cylindrical openings in each vertical skeletal support, and i. a polygonal shelf adapted to have the free edges thereof resting on a supporting element on the same level mounted in each skeletal support adjacent said corner and extending perpendicularly from the walls of the room, and the inner portion of said shelf adapted to rest on a cylindrical rod detachably mounted in an opening of said vertical post at said same level.

* * * * *